US006452103B1

(12) United States Patent
Piriz et al.

(10) Patent No.: US 6,452,103 B1
(45) Date of Patent: Sep. 17, 2002

(54) COMPRESSION CONNECTOR

(75) Inventors: Jose M. Piriz, Collierville, TN (US); Sidney A. David, Holmdel, NJ (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 08/914,365

(22) Filed: Aug. 19, 1997

(51) Int. Cl.[7] ..... H01R 4/00
(52) U.S. Cl. ..... 174/84 C; 174/94 R; 174/71 R
(58) Field of Search ..... 174/84 C, 84 R, 174/94 R, 71 R, 74 R; 439/98, 877, 882

(56) References Cited

U.S. PATENT DOCUMENTS

| | | | | | |
|---|---|---|---|---|---|
| 2,707,775 | A | | 5/1955 | Hoffman et al. | |
| 2,884,478 | A | * | 4/1959 | Becker et al. | 174/94 |
| 2,938,069 | A | | 5/1960 | Toedtman et al. | 174/94 |
| 2,956,108 | A | | 10/1960 | Brenner | 174/94 |
| 2,964,585 | A | | 12/1960 | Nilsson et al. | 174/94 |
| 3,009,987 | A | | 11/1961 | Brenner | 174/94 |
| 3,022,370 | A | | 2/1962 | Osborn | 174/71 |
| 3,032,603 | A | | 5/1962 | Whitley | 174/94 |
| 3,053,930 | A | | 9/1962 | Mallanik et al. | 174/94 |
| 3,088,993 | A | | 5/1963 | Matthysse et al. | 174/71 |
| 3,156,764 | A | | 11/1964 | Toedtman | 174/941 |
| 3,183,025 | A | | 5/1965 | Lynch, Jr. et al. | 287/78 |
| 3,235,654 | A | | 2/1966 | Eldridge, Jr. | 174/94 |
| 3,236,938 | A | | 2/1966 | Toedtman | 174/94 |
| 3,322,888 | A | | 5/1967 | Zemels | 174/94 |
| 3,330,903 | A | | 7/1967 | Holke et al. | 174/94 |
| 3,340,352 | A | | 9/1967 | Teagno et al. | 174/94 |
| 3,354,517 | A | * | 11/1967 | Levinsky | 24/123 |
| 3,408,455 | A | | 10/1968 | Dannes | 174/94 |
| 3,448,432 | A | | 6/1969 | Watlington | 340/5 |
| 3,746,777 | A | * | 7/1973 | Peek | 174/94 |
| 3,781,459 | A | * | 12/1973 | Peek | 174/94 |
| 3,897,992 | A | | 8/1975 | Weidler | 339/97 C |
| 4,350,843 | A | * | 9/1982 | Campbell et al. | 174/94 |
| 4,940,856 | A | | 7/1990 | Bock | 174/94 R |
| 4,950,838 | A | | 8/1990 | Gordon | 174/94 R |
| 5,103,068 | A | * | 4/1992 | Schrader | 174/94 R |
| 5,162,615 | A | * | 11/1992 | Schrader et al. | 174/94 |
| 5,200,576 | A | | 4/1993 | Schrader et al. | 174/94 R |
| 5,396,033 | A | * | 3/1995 | Piriz et al. | 174/94 |
| 5,552,564 | A | * | 9/1996 | Schrader et al. | 174/84 |
| 5,635,676 | A | * | 6/1997 | Piriz | 174/84 |

FOREIGN PATENT DOCUMENTS

| | | |
|---|---|---|
| DE | 20 11 859 | 10/1970 |

* cited by examiner

*Primary Examiner*—Dean A. Reichard
*Assistant Examiner*—William H Mayo, III
(74) *Attorney, Agent, or Firm*—Hoffmann & Baron, LLP

(57) ABSTRACT

An electrical connector for crimpable connection about an electrical conductor upon application of a crimping force imparted by the opposing arcuate dies of a crimping tool. The connector includes an elongate connector body formed of a compressible material. The connector body has an elongate first planar face and an elongate second planar face. The first planar face is opposed to the second planar face. One end of the connector body is defined by an arcuate wall extending between the first planar face and the second planar face. The other end of the connector body defines a first open ended conductor receiving nest. The connector body further defines a second open ended conductor receiving nest and a third open ended conductor receiving nest whereby the second and third conductor receiving nests are located adjacent to the arcuate wall and open in substantially opposite directions. The connector body provides no more than three points of contact with the opposing dies of the crimping tool prior to crimping.

12 Claims, 3 Drawing Sheets

COMPRESSION CONNECTOR

FIELD OF THE INVENTION

The present invention relates generally to compression type connectors for connecting electrical conductors. More particularly the present invention relates to improvements in compression electrical connectors, which may be more reliably crimped around electrical conductors using a suitable crimping tool.

BACKGROUND OF THE INVENTION

Compression connectors for connecting together two or more electrical conductors are well-known. Connectors such as these typically accommodate stripped electrical conductors in individual connector nests. A suitable crimping tool is used to crimp the connector around the conductors. Many of these compression-type connectors are of the H-tap variety, that is, the connector body has an H-shaped cross section. H-taps provide upper and lower conductor nests, each nest being defined by a bottom wall and opposed upstanding sidewall. The sidewalls are adapted to be deformed upon application of a crimping force applied by a crimping tool to draw the sidewalls around the conductor to thereby compress the conductor within the nest of the H-tap.

In U.S. Pat. No. 2,964,585, an H-tap compression connector is shown. The upper ends of the sidewalls are dimensioned to have relatively equal lengths so that upon crimping, the upper edges may not completely encircle the conductor. An attempt to lengthen the sidewalls could result in the sidewalls contacting each other during crimping prior to encircling the conductor thereby resulting in an ineffective crimp.

Attempts to prevent sidewalls from interfering with their proper deformation are seen in U.S. Pat. No. 3,235,654 where a bendable tab is provided at the outer edge of one of the sidewalls. Once the conductor is inserted in the nest the bendable tab may be manually folded over the conductor so that during crimping the conductor is entirely enclosed. Other examples of such connectors are shown in U.S. Pat. No. 3,354,517, 3,330,903, 3,332,888, and 5,162,615.

U.S. Pat. No. 5,636,676 shows another attempt to provide a completely enclosed crimp in an H-tap by including a die-engagement extent at the free end of one sidewall. The die engagement extent is attached to the sidewall by a weakened portion which facilitates crimping deformation of the sidewall thereat, upon application of a crimping force.

The problem of supporting the conductors in the connector and accurately maintaining the connector between the dies of a crimping tool is particularly significant in connectors which permit side or lateral entry of conductors. U.S. Pat. No. 5,200,576 shows such a side entry connector. Due to the multiple points of die engagement, especially adjacent the side entry locations, centering of the connector in the dies may not be assured. Without proper alignment, the crimping forces may be applied to the connector body so as to deform the body in a manner which does not bend the sidewalls in the desired direction at the desired moment or in the desired order.

It is therefore desirable to provide a compressible side entry connector for crimping engagement with a number of conductors that provides more reliable centering and alignment of the connector with the crimping dies prior to crimping.

SUMMARY OF THE INVENTION

It is an object of the present invention to provide an electrical connector for crimping about an electrical cable.

It is another object of the present invention to provide compression connection which fully encircles at least one conductor upon crimping.

It is yet another object of the present invention to provide a compression connector having non-manually-bendable sidewalls where one side wall is designed to deform more than its opposing sidewall to reliably provide overlapping crimping around a conductor.

It is still another object of the present invention to provide a side entry compression connector which reliably maintains alignment within a single die of a pair of opposed crimping dies prior to crimping.

It is yet still another object of the present invention to provide a side entry compression connector which may accommodate at least three conductors.

In the efficient attainment of these and other objects, the present invention provides an electrical connector for crimpable connection about an electrical conductor upon application of a crimping force imparted by the opposing arcuate dies of a crimping tool. The connector includes an elongate connector body formed of a compressible material. The connector body has an elongate first planar face and an elongate second planar face. The first planar face is opposed to the second planar face. One end of the connector body is defined by an arcuate wall extending between the first planar face and the second planar face. The other end of the connector body defines a first open ended conductor receiving nest. The connector body further defines a second open ended conductor receiving nest and a third open ended conductor receiving nest whereby the second and third conductor receiving nests are located adjacent to the arcuate wall and open in substantially opposite directions. The connector body provides no more than three points of contact with the opposing dies of the crimping tool prior to crimping.

DETAILED DESCRIPTION OF THE PREFERRED EMBODIMENT

Figure 1:
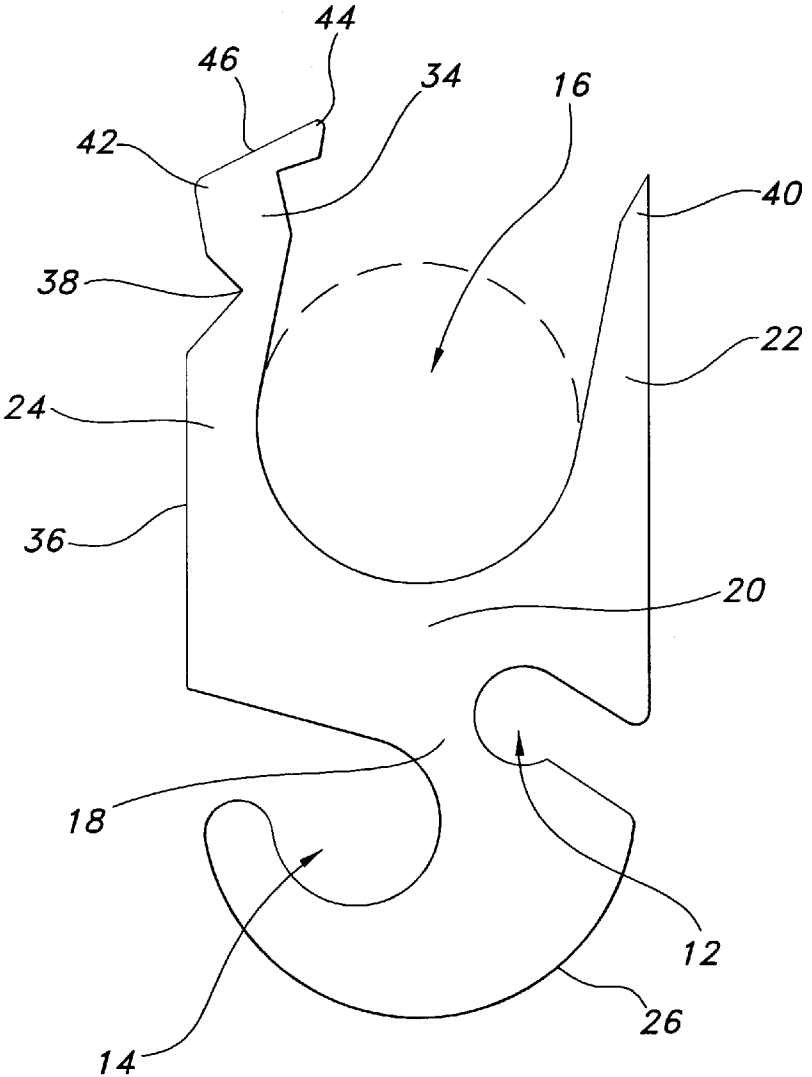
FIG. 1 is a front plan view of a compression connector of the present invention.

Referring to FIG. 1, a compression connector 10 of the present invention is shown. Connector 10 is formed of a suitably conductive metal such as copper and is cut from an extruded length. Copper is selected as the preferable material for its high electrical conductivity as well as its ability to be suitable crimped by a crimping tool (not shown). It is, however, understood that other conductive metals such as aluminum may be employed and other forming techniques such as casting may also be used to form the connector of the present invention.

Connector 10 provides a pair of opposed side-facing conductor receiving nests 12 and 14 as well as an elongate upward-facing conductor receiving nest 16. Nests 12 and 14 are separated by neck 18 of the connector. Conductor receiving nest 16 is defined by the base wall 20 and a pair of opposed upstanding sidewalls 22 and 24. Neck 18 joins base wall 20 at about its midpoint. Nests 12 and 14 open onto opposing sidewalls 22 and 24, respectively, adjacent opposite ends of arcuate endwall 26.

As may be appreciated, the size and shape of connector 10 may be varied to accommodate various lengths and thicknesses (diameters) of cable. However, the sidewalls, 22 and 24, are selected such that when a conductor is placed in nest 16 and suitably crimped, sidewalls 22 and 24 will overlap each other to encircle the conductor supported within nest 16. Additionally, endwall 26 may be selected to engage a lower die of a crimping tool having an equal or greater radius of curvature than endwall 26, so that connector 10 will self-center between the dies of a crimping tool and provide a more reliable crimping.

Figures 2, 3, 4:
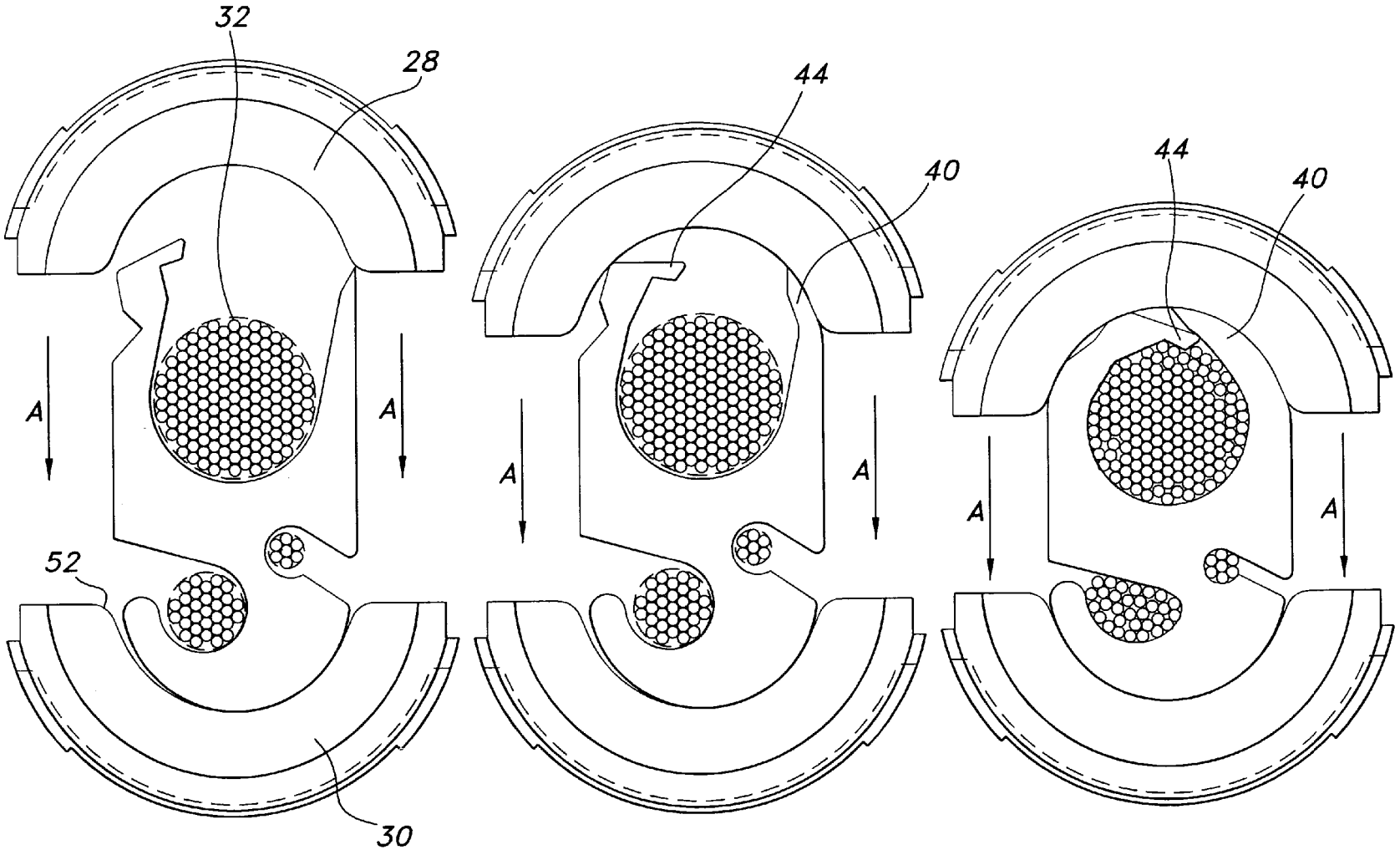
FIG. 2 shows the compression connector of FIG. 1 positioned between opposing arcuate dies of a crimping tool, just prior to crimping.
FIG. 3 shows the compression connector of FIG. 1 positioned between opposing arcuate dies of a crimping tool, just after crimping begins.
FIG. 4 shows the compression connector of FIG. 1, substantially crimped, between opposing arcuate dies of a crimping tool.

As shown in FIGS. 2–4, an upper die 28 engages the free end of sidewalls 22 and 24 while a lower die 30 engages endwall 26. Preferably, endwall 26 will have a slightly smaller radius of curvature than the die of the crimping tool so as to provide no more than three points of contact between connector 10 and the dies of a crimping tool prior to crimping. Although, even when endwall 26 has the same radius of curvature as the die of the crimping tool, connector 10 provides three points of contact: a first and second distinct point of contact on each side wall 22 and 24, and a third continuous point of contact along endwall 26. By providing three points of contact with the dies of a crimping tool, connector 10 will self-center between the dies. Centering connector 10 within the dies helps assure the connector will crimp in a desirable manner, as is described below.

With respect to nest 16, upstanding sidewalls 22 and 24 are deformed inwardly by the crimping tool. Suitable crimping dies, such as those shown in FIGS. 2–4, force the sidewalls around the conductor supported within nest 16. The upstanding sidewalls 22 and 24 are directly engagable by a die 28 of a crimping tool. As shown in FIGS. 2–4, die 28 is movable directly into engagement with sidewalls 22 and 24 to progressively deform the sidewalls about a supported cable 32.

In order to assure that sidewall 24 is able to tuck under sidewall 22 upon crimping, the present invention provides that sidewall 24 be formed to be longer than sidewall 22. Also, sidewall 24 is formed to cant towards sidewall 22 so that even before crimping begins the free end 34 of sidewall 24 will already extend over a portion of supported cable 32. Furthermore, the outer surface 36 of sidewall 24 includes a v-shaped groove 38 to weaken sidewall 24 so that during the crimping operation it will deform faster than the other sidewall 22. Groove 38 provides an areas of reduced thickness for sidewall 24 thereby weakening the strength of the sidewall thereabout. The shape of groove 38 is conducive to collapsing upon compression, thereby driving free end 34 inwardly of sidewall 24. Sidewall 22, on the other hand, has a shape that tapers to a point at free end 40. As sidewall 22 gets progressively stronger from free end 40, sidewall 22 will therefore begin to deform at free end 40 under the compression of dies 28 and 30.

With further reference to FIG. 1, a raised bump 42 is provided on free end 34 to make an initial engagement with die 28 prior to crimping. As sidewall 24 tapers towards free end 40 it is necessary to increase the thickness of free end 34 outwards to ensure simultaneous engagement of free ends 24 and 40 with upper die 28. Furthermore, free end 34 of sidewall 24 includes a projecting tab 44 extending generally across and away from nest 16. Tab 44 is contiguous with bump 42 by planar surface 46.

Referring now to FIGS. 2–4, the successive step in the crimping cycle may be seen. Stripped electrical conductors 32, 48 and 50 are supported within nests 16, 12, and 14, respectively. A conventional crimping tool (not shown) having dies 28 and 30, specifically designed for crimping connectors, exerts a uniform crimping force A on sidewalls 22 and 24, as well as end wall 26 so that a compression connection is achieved between conductors 32, 48, and 50. Die 30 includes interior surface 52 which engages end wall 26 of connector 10. Interior surface 52 has a radius of curvature equal to or greater than end wall 26 so that connector 10 will center itself within die 30 prior to crimping. The closer the dimensions of surface 52 and end wall 26, the better the alignment of connector 10 between dies 28 and 30, and thereby, the higher the assurance that die 28 will simultaneously engage bump 42 and free end 40.

Upon application of the uniform crimping force, by which die 28 moves along arrow A with respect to die 30, sidewall 22 initially engages die 28 at bump 42. Planar surface 46 deflects away from the inside surface of die 28 so that tab 44 always extends away from the die. As free end 40 of sidewall 22 is continuously in contact with die 28 during crimping, free end 24 will pass clear to the inside of free end 40 throughout the crimping. Meanwhile, nests 12 and 14 are seen to deform about conductors 48 and 50 so as to hold each in their respective nests.

Figure 5:
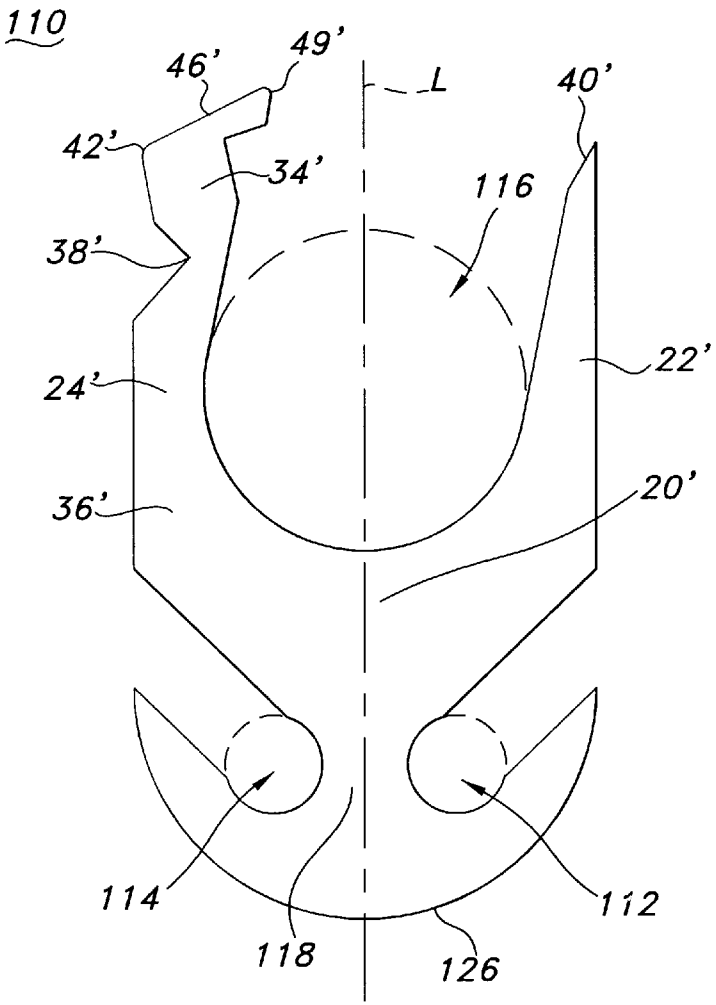
FIG. 5 shows an alternate embodiment of the compression connector of the present invention.

An additional embodiment of the present invention is shown in FIG. 5. Compression connector 110 provides a pair of opposed side-facing conductor receiving nests 112 and 114 which incline upwards, and an upward-facing conductor receiving nest 116. Nests 112 and 114 are separated by a central neck 118 of connector 110 and open on opposite ends of arcuate endwall 126. Preferably, nests 112 and 114 are symmetrically situated about a longitudinal axis L of connector 110 and will deform similarly upon crimping. Endwall 126 is preferably selected to have a radius of curvature that is equal to or less than the radius of curvature of the surface of the die of the crimping tool that it engages. Connector 110 therefore provides no more than three points of contact with the crimping tool prior to crimping so that, as was described for connector 10, connector 110 will self-center in the tool die and further assure proper alignment with the tool dies when crimping.

Conductor receiving nest 116 is defined by similarly situated and numbered components as provided by and described for connector 10. Nest 116 is defined between connector base 20' and sidewalls 22' and 24'. Sidewall 22' extends from connector base 20' and tapers to a pointed edge at free end 40'. Sidewall 24' extends from connector base 20' and angles towards sidewall 22'. Sidewall 24' terminates at a free end 34' which extends longitudinally past free end 40'.

Free end 34' includes a v-shaped groove 38' and a die-engaging bump 42'. Projecting tab 44' extends generally across and away from nest 116. Tab 44' is contiguous with bump 42' by planar surface 46'. During crimping, bump 42' will engage a die of the crimping tool similarly as described in FIGS. 2–4 for connector 10 and tab 44' will tuck underneath free end 40' of sidewall 22'.

Figure 6:
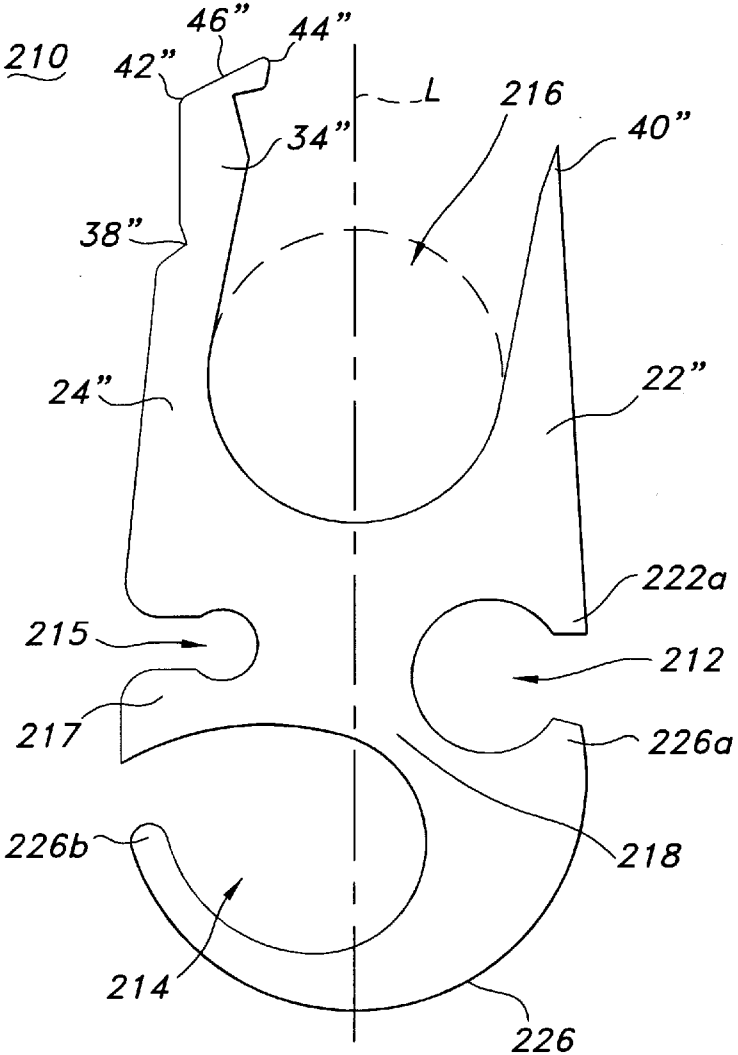
FIG. 6 shows another alternate embodiment of the compression connector of the present invention.

Yet another embodiment of the present invention is shown in FIG. 6. Compression connector 210 provides three side-facing conductor receiving nests 212, 214, and 215, and an upward-facing conductor receiving nest 216. Nests 212 and 214 are separated by a neck 218 of connector 210 and open on opposite ends of arcuate endwall 226. Nest 215 is separated from nest 214 by a side projecting tang 217. Preferably, 214 extends past the longitudinal axis L of connector 210 and will substantially close upon crimping.

The crimping operation will tend to force neck 218 into nest 212 so as to compress a conductor (not shown) therein. The crimping operation will therefore force opposed endwall portions 216*a* and 216*b* towards sidewall end 222*a* and tang 217. Engagement between endwall portion 216*b* and tang 217 will ensure crimping of a conductor (not shown) placed in nest 215. Endwall 226 is preferably selected to have a radius of curvature that is equal to or less than the radius of curvature of the surface of the die of the crimping tool that it engages. Connector 210 therefore provides no more than three points of contact with the crimping tool prior to crimping so that, as described for connector 10, connector 210 will self-center in the tool die and further assure proper alignment with the tool dies when crimping.

Free end 34" includes a v-shaped groove 38" and a die-engaging bump 42". Projecting tab 44" extends generally across and away from nest 216. Tab 44" is contiguous with bump 42" by planar surface 46". During crimping, bump 42" will engage a die of the crimping tool similarly as described in FIGS. 2–4 for connector 10 and tab 44" will tuck underneath free end 40" of sidewall 22".

While the preferred embodiment of the present invention has been shown and described, it will be obvious in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical connector for crimpable connection about an electrical conductor upon application of a crimping force imparted by opposing arcuate dies of a crimping tool, said connector comprising:

an elongate connector body formed of a compressible material, said connector body including an elongate first planar face and an elongate second planar face, said first planar face being opposed to said second planar face, one end of said connector body being defined by a continuous arcuate wall extending between said first planar face and said second planar face for engaging one arcuate die of the crimping tool, the other end of said connector body defining a first open ended conductor receiving nest, said connector body further defining a second open ended conductor receiving nest and a third open ended conductor receiving nest, said second and third conductor receiving nests being adjacent said arcuate wall and opening in substantially opposite directions, said connector body providing no more than three points of contact with said opposing dies of the crimping tool prior to crimping.

2. A connector of claim 1, wherein said second receiving nest and said third receiving nest are axially-divergent.

3. An electrical connector of claim 1, wherein said connector body includes a connector base, a first deformable sidewall upstanding from said connector base, and a second deformable sidewall upstanding from said connector base, said first sidewall being spaced apart from said second sidewall, and said connector base and said first and second sidewalls defining interiorly thereof said first conductor receiving nest.

4. An electrical connector of claim 3, wherein said second conductor receiving nest opens towards said first side wall and said third receiving nest opens towards said second sidewall.

5. An electrical connector of claim 3, wherein said second conductor receiving nest is further defined by a conductor receiving portion and a conductor insertion portion, said conductor receiving portion being accessible from said first sidewall through said conductor insertion portion, said conductor receiving portion defining an expanse larger than an expanse of said conductor insertion portion.

6. A connector of claim 3, further including a neck portion, said neck portion joining said arcuate wall to said connector base, said neck portion being deformable from an initial configuration to a final configuration, said initial configuration allowing said second and third conductor receiving nests to accommodate a conductor, and said final configuration providing crimping connection between said connector body and said inserted conductors.

7. A connector of claim 1, wherein said connector body further defines a first leg and a second leg, said first conductor receiving nest being defined between said first and second legs.

8. A connector of claim 7, wherein said first leg has a length which is greater than a length of said second leg.

9. An electrical connector of claim 7, wherein said first leg includes a distal extent extending towards said second leg.

10. A connector of claim 7, wherein said first leg includes a v-shaped groove adjacent said distal extent exterior of said first conductor receiving nest.

11. A connector of claim 7, wherein said distal extent of said first leg includes a tab, said tab being deformable towards said second leg under compression of the crimping tool.

12. A connector of claim 1, further including a fourth conductor receiving nest, said fourth conductor receiving nest communicating between said first face and said second face, said fourth receiving nest opening onto said first sidewall.

* * * * *